United States Patent [19]

Sugiyama

[11] Patent Number: 5,030,140

[45] Date of Patent: Jul. 9, 1991

[54] ELECTRICAL CONNECTOR

[75] Inventor: Keishi Sugiyama, Yao, Japan

[73] Assignee: Hosiden Electronics Co., Ltd., Yao, Japan

[21] Appl. No.: 541,746

[22] Filed: Jun. 21, 1990

[30] Foreign Application Priority Data

Jun. 27, 1989 [JP] Japan ..... 1-75212[U]

[51] Int. Cl.[5] ..... H01R 13/648

[52] U.S. Cl. ..... 439/607; 439/78; 439/746

[58] Field of Search ..... 439/744, 746, 767, 607-610, 439/92, 95, 101, 105, 108, 901-906, 78

[56] References Cited

U.S. PATENT DOCUMENTS

| | | | |
|---|---|---|---|
| 4,637,669 | 1/1987 | Tajima | 439/105 |
| 4,708,412 | 11/1987 | Himes et al. | 439/607 |
| 4,842,554 | 6/1989 | Cosmos et al. | 439/609 |
| 4,929,189 | 5/1990 | Sekiguchi | 439/610 |
| 4,946,400 | 8/1990 | Kawai et al. | 439/609 |
| 4,954,097 | 9/1990 | Sekiguchi | 439/352 |

*Primary Examiner*—David L. Pirlot
*Attorney, Agent, or Firm*—Jones, Tullar & Cooper

[57] ABSTRACT

The electrical connector in accordance with the present invention may be distributed with the shield frame thereof temporarily mounted on the connector body thereof. While the shield frame is temporarily mounted, a portion of the connector body is restrained between engagement pawls or projections formed on the shield frame. While the shield frame is temporarily mounted, the shield frame is backed up by the connector body, thus preventing the shield frame from being readily deformed. When the shield frame is pushed to the connector body with a force sufficient to resiliently deform the engagement pawls on the shield frame, the shield frame may be moved from a temporary-fitting position to a final-fitting position. At the final-fitting position, the engagement pawls of the shield frame are engaged with final-fitting engagement portions of the connector body by the restoring force of contact pieces which are formed at the lower end of the shield frame and which are pressingly contacted with a member on which the electrical connector is mounted.

18 Claims, 6 Drawing Sheets

FIG. 6
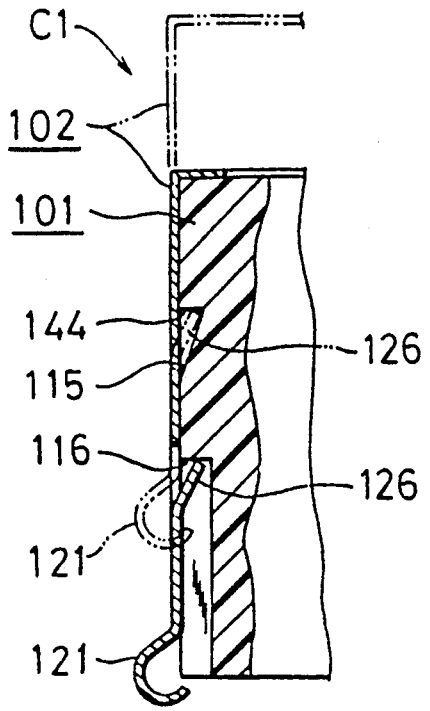
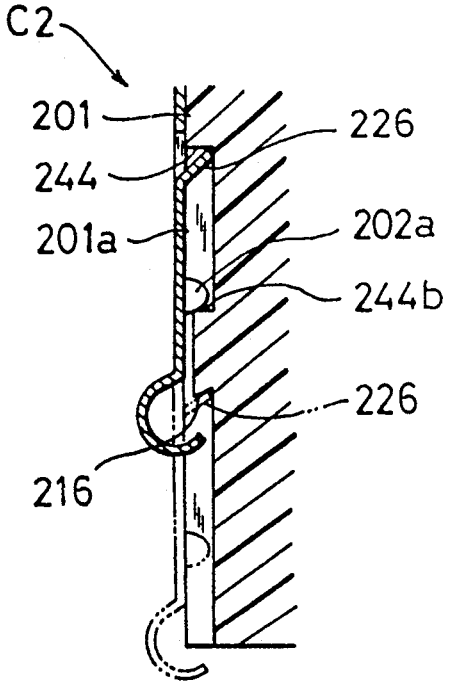
FIG. 7
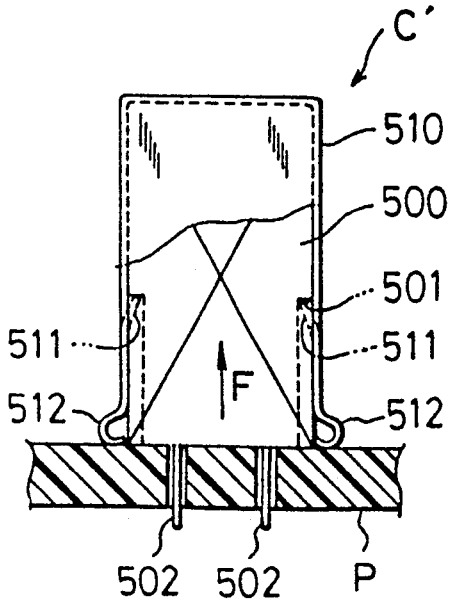
FIG. 8
(PRIOR ART)

ELECTRICAL CONNECTOR

BACKGROUND OF THE INVENTION

1. Field of the Invention

The present invention relates to an electrical connector having a connector body and a shield frame mounted thereon.

2. Description of the Invention

When a shield frame and a connector body are not assembled as a unitary structure and are independently distributed unlike the electrical connector abovementioned, it is a matter of course that such connector elements lack handling convenience and workability in the middle course of distribution or when the connector is mounted on a circuit board. Further, the shield frame, which is made by bending a thin-sheet material, is handled as an independent article. This may cause inconvenience in that the shield frame may be deformed due to a shock received at the time of handling.

To minimize such inconvenience, it is be proposed to assemble, in a production line, the shield frame and the connector body to produce a completed article of electrical connector and to distribute or mount the same on a circuit board.

In a conventional electrical connector C′ shown in FIG. 8, a shield frame 510 is mounted on a connector body 500. This electrical connector C′ is mounted on a circuit board P. The shield frame 510 is provided at lateral sides thereof with upwardly inclined engagement pawls 511 and at the lower end thereof with resilient contact pieces 512. The connector body 500 has an engagement portion 501 in the form of a slot. The engagement of the engagement pawls 511 with the engagement portion 501 prevents the shield frame 510 from being separated from the connector body 500. When the electrical connector C′ is mounted on the circuit board P, the contact pieces 512 are pressed to and come in surface-contact with the circuit board P. This produces shielding results.

When mounting the electrical connector C′ in FIG. 8 on the circuit board P, the following step is required. That is, with the contact pieces 512 of the shield frame 510 bent as they are pushed to the circuit board P, terminals 502 are soldered to the circuit board P. At this soldering step, the restoring force F of the contact pieces 512 is applied in such a direction as to raise the electrical connector C′. This may involve the likelihood that the electrical connector C′ after being mounted on the circuit board P comes up therefrom, or that the contact pieces 512 are restored to a certain extent, failing thereby to produce the required contact pressure.

SUMMARY OF THE INVENTION

In view of the foregoing, the present invention has as an object the provision of an electrical connector which can be distributed or mounted on a circuit board with the shield frame temporarily fitted on the connector body, thereby enabling the shield frame and the connector body to be integrally handled as a unitary structure, so that there is no likelihood that the connector body will come up from the circuit board and the contact pieces of the shield frame present insufficient contact pressures.

To achieve the noted object the electrical connector in accordance with an embodiment of the present invention has a connector body and a shield frame fittingly mounted on the connector body, the shield frame being provided at the lower end thereof with contact pieces adapted to be pressingly contacted with a member on which the electrical connector is to be mounted, and comprises:

at least one upwardly inclined engagement pawl which projects inwardly from a lateral side of the shield frame;

at least one temporary-fitting engagement portion adapted to be engaged with the tip of the engagement pawl when the shield frame is pushed to a temporary-fitting position where the contact pieces do not project from the lower end of the connector body, the temporary-fitting engagement portion being formed on the connector body;

at least one final-fitting engagement portion adapted to be engaged with the tip of the engagement pawl when the shield frame is pushed to a final-fitting position where the contact pieces project from the lower end of the connector body, the final-fitting engagement portion being formed on the connector body; and at least one inclined surface adapted to be engaged with the back side of the engagement pawl at the temporary-fitting position, the inclined surface being formed on the connector body.

To achieve the noted object, the electrical connector in accordance with another embodiment of the present invention has a connector body and a shield frame fittingly mounted on the connector body, the shield frame being provided at the lower end thereof with contact pieces adapted to be pressingly contacted with a member on which the electrical connector is to be mounted, and comprises:

an upwardly inclined engagement pawl which projects inwardly from a lateral side of the shield frame;

a projection projecting inwardly from a lateral side of the shield frame;

a temporary-fitting engagement portion with which the tip of the engagement pawl is adapted to be engaged when the shield frame is pushed to a temporary-fitting position where the contact pieces do not project from the lower end of the connector body, the temporary-fitting engagement portion being formed on the connector body;

a temporary-fitting stepped portion with which the projection is adapted to be engaged when the shield frame is pushed to the temporary-fitting position, the stepped portion being formed on the connector body; and a final-fitting engagement portion with which the tip of the engagement pawl is adapted to be engaged when the shield frame is pushed to a final-fitting position where the contact pieces project from the lower end of the connector body, the final-fitting engagement portion being formed on the connector body.

To achieve the noted object, the electrical connector in accordance with a further embodiment of the present invention has a connector body and a shield frame fittingly mounted on the connector body, the shield frame being provided at the lower end thereof with contact pieces adapted to be pressingly contacted with a member on which the electrical connector is to be mounted, and comprises:

an upwardly inclined temporary-fitting engagement pawl which projects inwardly from a lateral side of the shield frame;

a final-fitting engagement pawl which projects inwardly from a lateral side of the shield frame;

a projection projecting inwardly from a lateral side of the shield frame;

a temporary-fitting engagement portion with which the tip of the temporary-fitting engagement pawl is adapted to be engaged when the shield frame is pushed to a temporary-fitting position where the contact pieces do not project from the lower end of the connector body, the temporary-fitting engagement portion being formed on the connector body;

a temporary-fitting stepped portion with which the projection is adapted to be engaged when the shield frame is pushed to the temporary-fitting position, this stepped portion being formed on the connector body; and a final-fitting engagement portion with which the tip of the final-fitting engagement pawl is adapted to be engaged when the shield frame is pushed to a final-fitting position where the contact pieces project from the lower end of the connector body, the final-fitting engagement portion being formed on the connector body.

According to the electrical connector having the arrangements mentioned, above when the shield frame is pushed to the connector body to the temporary-fitting position, the tip of the at least one engagement pawl on the shield frame is engaged with the temporary-fitting engagement portion, thereby preventing the shield frame from coming out from the connector body. At this temporary-fitting position, the back side of the engagement pawl or the projection is situated opposite to the inclined surface or temporary-fitting stepped portion of the connector body, simultaneously with the engagement above-mentioned. Accordingly, there is no possibility of the shield frame being pushed to the final-fitting position by such a small pushing force as not to resiliently deform the engagement pawl or shield frame. At the temporary-fitting position, since the contact pieces of the shield frame do not project from the lower end of the connector body, the contact pieces hardly receive a shock due to contact with other articles. At the temporary-fitting position, the shield frame is backed up by the connector body, thus protecting the shield frame from deformation such as distortion or the like.

When the connector body, with the shield frame temporarily fitted thereto, is mounted on a member such as a circuit board or the like, and the shield frame is then pushed to the final-fitting position, the contact pieces of the shield frame, as bent against the resiliency thereof, are pressingly contacted with the circuit board. At the final-fitting position, the resilient resetting force of the contact pieces causes the at least one engagement pawl to be engaged with the final-fitting engagement portion of the connector body. Thus, the shield frame is connected to the connector body in such a manner that the shield frame does not come out therefrom.

According to the electrical connectors mentioned, the shield frame may be temporarily fitted to the connector body in such a manner that the shield frame is hardly separated therefrom. Accordingly, the shield frame as temporarily fitted to the connector body in a unitary structure may be distributed or mounted on the circuit board. This advantageously eliminates the inconvenience of handling the shield frame as an independent product. Further, since the shield frame is temporarily fitted on the connector body, the shield frame and the contact pieces thereof are hardly deformed or broken. Although no need exists for handling of the shield frame as an independent product, the contact pieces may be contacted, with considerably great contact pressures, with the circuit board on which the electrical connector is being mounted, and the shield frame may be securely connected to the connector body. Thus, the electrical connector of the present invention produces excellent results.

Other various features and effects of the present invention will be apparent from the following description of embodiments thereof.

BRIEF DESCRIPTION OF THE DRAWINGS

FIG. 6 is a section view of main portions of the electrical connector in accordance with another embodiment of the present invention;

FIG. 7 is a section view of main portions of the electrical connector in accordance with a further embodiment of the present invention; and FIG. 8 is a section view of portions of a conventional electrical connector.

DETAILED DESCRIPTION OF THE PREFERRED EMBODIMENTS

An electrical connector C in accordance with the present invention shown in FIGS. 1 to 5, is a multipole connector incorporating, in parallel, a number of contacts 3 in a connector body 1. The connector body 1 is covered, at the circumference thereof, with a shield frame 2.

Figure 1:
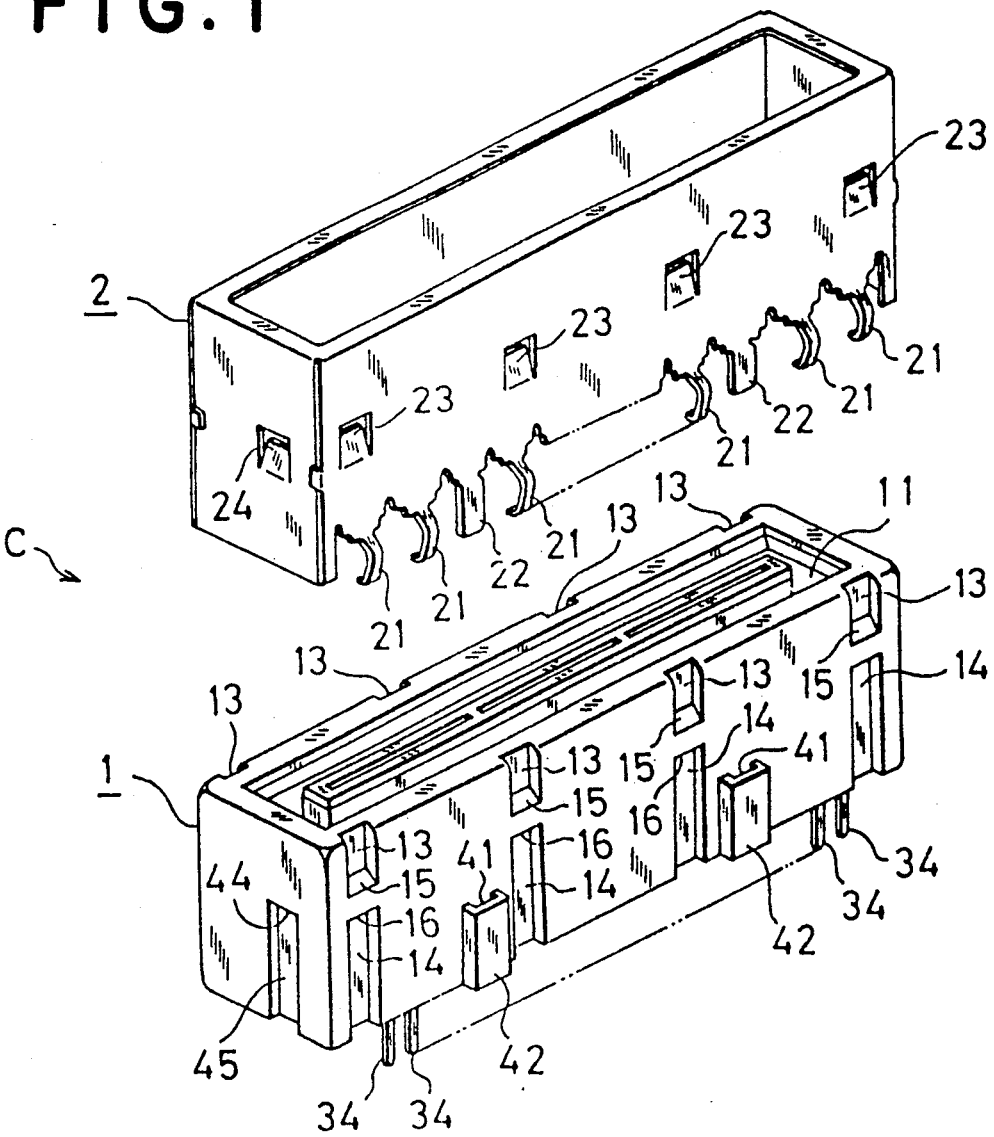
FIG. 1 is a perspective view of the electrical connector in accordance with an embodiment of the present invention.

As shown in FIG. 1, the connector body 1 is made substantially in the form of a rectangular parallelpiped and has, at its top, an opening 11 into or from which a plug (not shown) is adapted to be inserted or removed.

The connector body 1 is provided, at the upperhalf portions of the wider lateral sides thereof, with a plurality of upper slots 13 at predetermined spatial intervals. The connector body 1 is also provided, at the lower-half portions of the wider lateral sides thereof, with a plurality of lower slots 14 at predetermined spatial intervals, the lower slots 14 respectively corresponding to the upper slots 13. As shown in detail in FIGS. 2 and 4, the upper slots 13 are provided at the lower end portions thereof with inclined surfaces 15 which are inclined upwardly from the bottoms of the slots 13. The lower slots 14 are provided, at the inner parts of the upper ends thereof, with final-fitting engagement portions 16. The connector body 1 is also provided, at the lower ends of the wider lateral sides thereof, with positioning projections 42 having openings 41 which extend vertically therein.

The connector body 1 is also provided, at the lower portions of the narrower lateral sides thereof, with slots 45. The upper ends of the slots 45 form stepped temporary-fitting engagement portions 44.

Figure 2:
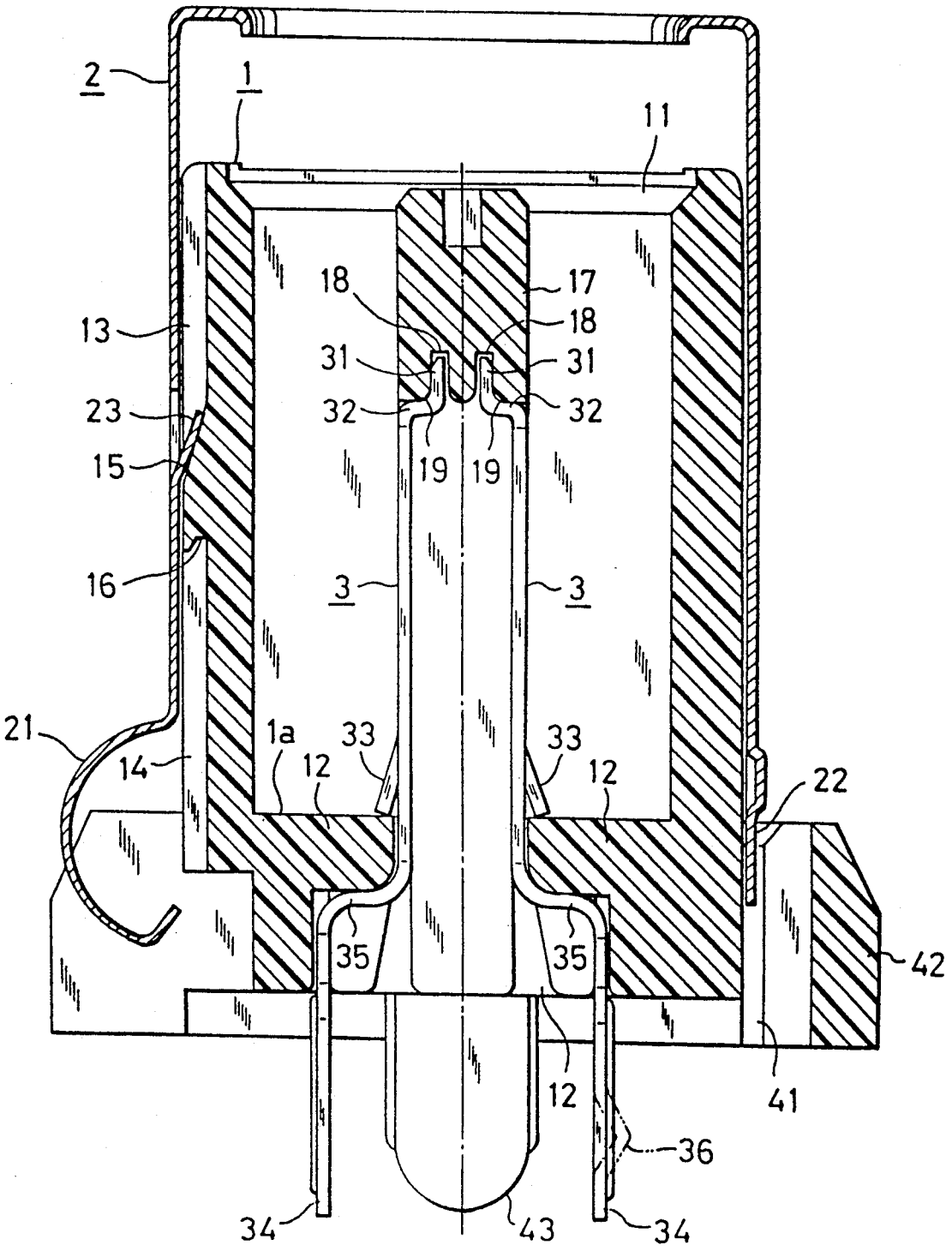
FIG. 2 is an enlarged vertical section view in side elevation of the electrical connector with a shield frame temporarily fitted.
Figure 4:
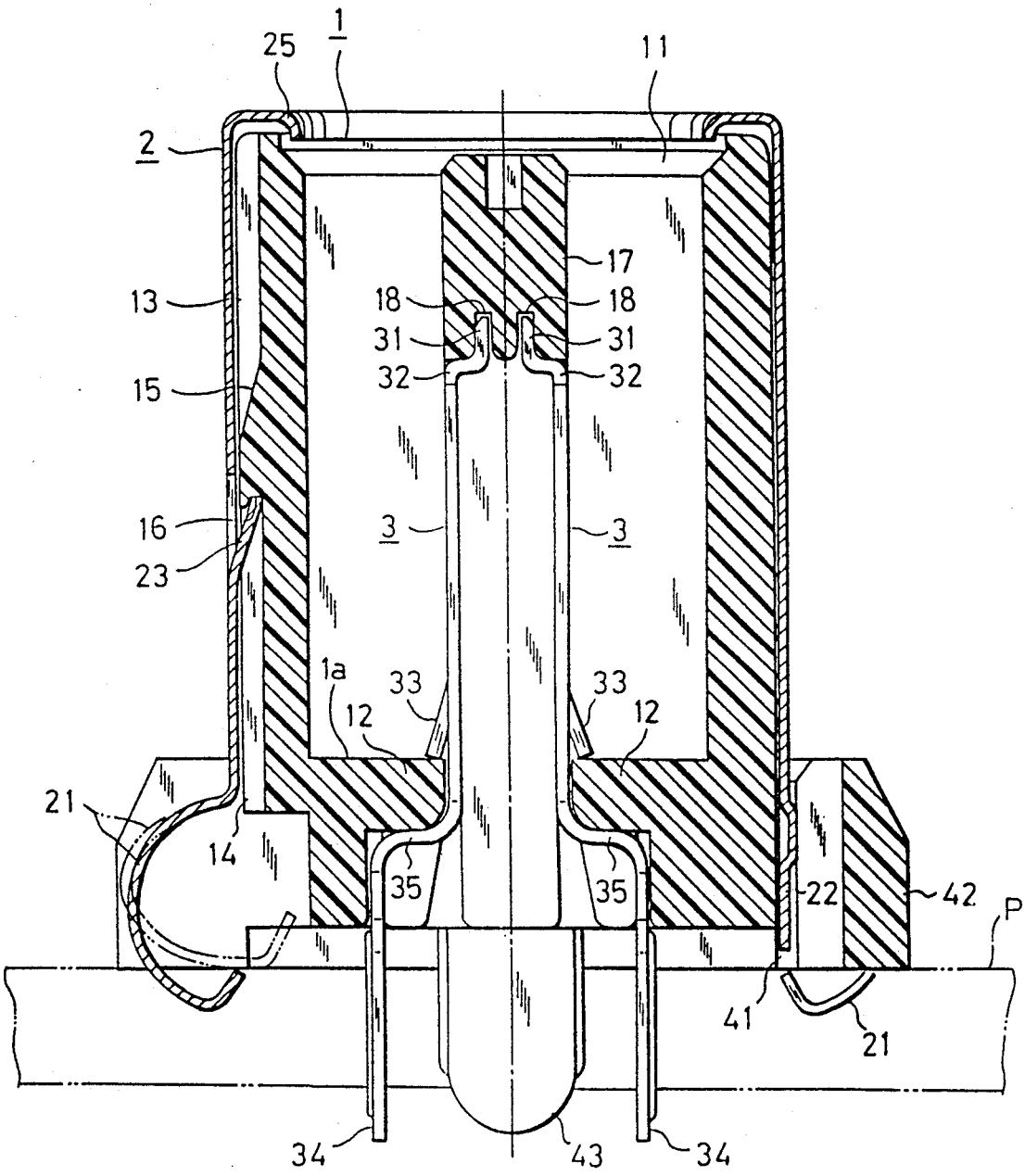
FIG. 4 is an enlarged vertical section view in side elevation of the electrical connector with the shield frame finally fitted.

As shown in FIGS. 2 and 4, the contacts 3 incorporated in the connector body 1 extend vertically, and the upper ends of the contacts 3 are bent in a step manner. More specifically, each contact 3 is provided at the upper end thereof with a horizontal shoulder portion 32 and a vertical tip 31 extending from the shoulder portion 32. The tips 31 are inserted into recesses 18 formed in a contact support portion 17 in the connector body 1. The shoulder portions 32 are engaged with the lower surface 19 of the contact support portion 17. The contacts 3 have cutraised engagement pawls 33 which are engaged with a bottom surface la of the connector body 1. That is, the contacts 3 are held, at the portions thereof between the shoulder portions 32 and the engagement pawls 33, by and between the lower surface 19 of the contact support portion 17 and the bottom surface 1*a* of the connector body 1 such that the contacts 3 are not loosened. This securely prevents the contacts 3 from being vertically moved from predetermined positions. Further, the tips 31 of the contacts 3 are fitted into the recesses 18, so that the contacts 3 are securely positioned.

The contacts 3 have external terminals 34 which project downwardly from the connector body 1. The external terminals 34 are provided at the base portions thereof with stepped portions 35. The bottom wall 12 of the connector body 1 is held by and between the stepped portions 35 and the engagement pawls 33. Preferably, the external terminals 34 have V-shaped projections or turned portions 36 as shown by virtual lines in FIG. 2. When the external terminals 34 of the electrical connector C are inserted into mounting holes in a circuit board P, to be discussed later, for mounting the electrical connector C on the circuit board P, such turned portions 36 are adapted to come in contact with the edges of the mounting holes, causing the external terminals 34 to support themselves.

Projections 43 project downwardly from the connector body 1 at both longitudinal ends thereof. When the electrical connector C is mounted on the circuit board P, the projections 43 are adapted to position the connector body 1 at a predetermined position of the circuit board P.

The shield frame 2 is made in the form of a box or a case having a rectangular section by bending a metallic thin sheet punched into a predetermined shape.

The shield frame 2 is provided, at the lower-end peripheral edges of the wider lateral sides thereof, with a number of contact pieces 21 and a plurality of hanging pieces 22. The contact pieces 21 are so curved as to expand outwardly, while the hanging pieces 22 are formed flat. The hanging pieces 22 may be inserted into the openings 41. The shield frame 2 is provided at the wider lateral sides thereof with engagement pawls 23 at predetermined spatial intervals. The shield frame 2 is also provided at the narrower lateral sides thereof with engagement pawls 24. These engagement pawls 23, 24 are formed by cutting and inwardly raising portions of the metallic thin sheet forming the shield frame 2.

In the arrangement mentioned above, the engagement pawls 23, 24, the temporary-fitting engagement portions 44 and the inclined surfaces 15 are useful for temporarily fixing the shield frame 2 to the connector body 1 at a temporary-fitting position thereof. The engagement pawls 23 and the final-fitting engagement portions 16 are useful for finally fixing the shield frame 2 to the connector body 1 at a final-fitting position thereof. More specifically, the temporary-fitting engagement portions 44 are formed at such positions as to be opposite to the tips of the engagement pawls 24 when the shield frame 2 is pushed to the temporary-fitting position. The inclined surfaces 15 are formed at such positions as to be opposite to the back sides of the engagement pawls 23 of the shield frame 2 as pushed to the temporary-fitting position. The final-fitting engagement portions 16 are formed at such positions as to be opposite to the tips of the engagement pawls 23 when the shield frame 2 is pushed to the final-fitting position.

Figure 3:
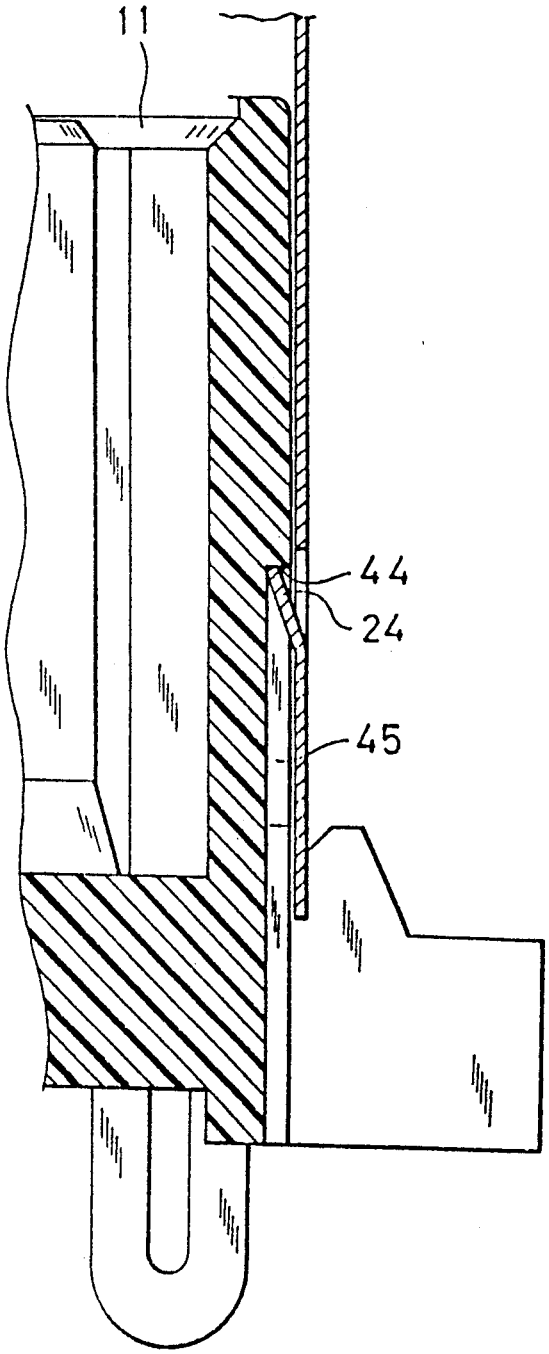
FIG. 3 is an enlarged vertical section view in front elevation of the electrical connector in FIG. 2.

When the shield frame 2 is pushed to the temporary-fitting position, the shield frame 2 is fitted, substantially at the lower-half portion thereof, to the connector body 1. At this time, the tips of the engagement pawls 24 on the narrower lateral sides of the shield frame 2 are engaged with the temporary-fitting engagement portions 44 of the connector body 1 as shown in FIG. 3, and the back sides of the engagement pawls 23 on the wider lateral sides of the shield frame 2 moves opposite to and come in contact with the inclined surfaces 15 of the connector body 1 as shown in FIG. 2.

The engagement pawls 23 may move opposite to the inclined surfaces 15 in a non-contact manner. In this case, it is not possible to produce the result that a portion of the connector body 1 is held by and between the tips of the engagement pawls 24 and the back sides of the engagement pawls 23, as occurs with the arrangement where the engagement pawls 23 come in contact with the inclined surfaces 15. This causes the connector body 1 to be slightly loosened with respect to the shield frame 2. Such looseness may cause of damage to the outer surface of the connector body 1, deformation of the shield frame 2 or the like. In view of the desire to prevent such inconvenience, it is preferred that the engagement pawls 23 come in contact with the inclined surfaces 15.

At the temporary-fitting position, the contact pieces 21 of the shield frame 2 do not project from the lower end of the connector body 1 and the hanging pieces 22 are inserted, at the tips thereof, into the openings 41 in the positioning projections 42, as shown in FIG. 2.

At the temporary-fitting position, the engagement pawls 24 are engaged, at the tips thereof, with the temporary-fitting engagement portions 44. This securely prevents the shield frame 2 from being separated from the connector body 1. When an external force in the pushing direction is applied to the shield frame 2, the back sides of the engagement pawls 23 come in contact with the inclined surfaces 15 to produce such action as to prevent the shield frame 2 from being further pushed. Accordingly, the engagement pawls 23 cannot get over the inclined surfaces 15 unless the external force is considerably great. This prevents the shield frame 2 from being carelessly pushed from the temporary-fitting position. Further, since the contact pieces 21 do not project from the lower end of the connector body 1, the contact pieces 21 hardly come in contact with other articles. Accordingly, at the time of handling, the contact pieces 21 hardly receive a shock, thus preventing the contact pieces 21 from being deformed. Further, the shield frame 2 is itself reinforced by the connector body 1 as a backing, thereby preventing the shield frame 2 from being dented or deformed.

Figure 5:
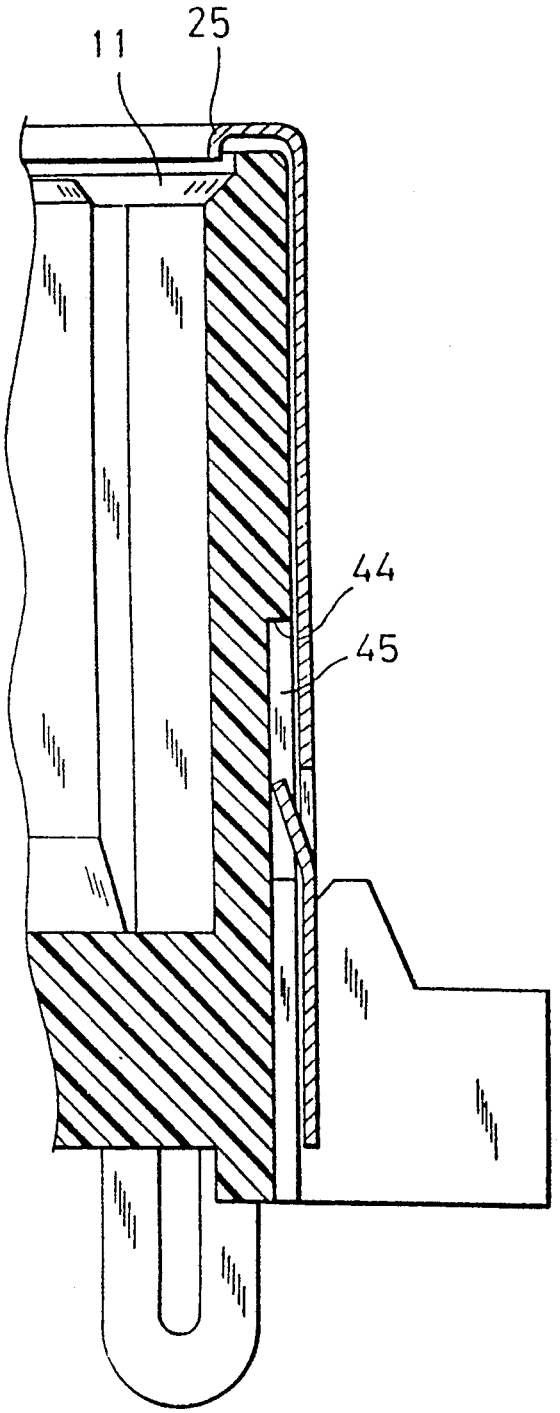
FIG. 5 is an enlarged vertical section view in front elevation of the electrical connector in FIG. 4.

When the shield frame 2 is pushed to the final-fitting position so that the shield frame 2 is fitted, substantially entirely in the height direction thereof, to the connector body 1, the engagement pawls 23 on the wider lateral sides of the shield frame 2 are engaged, at the tips thereof, with the final-fitting engagement portions 16 as shown in FIG. 4. At the same time, an upper-end peripheral edge 25 of the shield frame 2 is pushed to the peripheral edge of the opening 11 of the connector body 1 as shown in FIGS. 4 and 5. At the final-fitting position, the connector body 1 is held by and between the tips of the engagement pawls 23 and the upper-end peripheral edge 25, thus securely fixing the shield frame 2 to the connector body 1. In the state where the shield frame 2 is pushed to the final-fitting position, the contact pieces 21 project from the lower end of the connector body 1.

When the shield frame 2 is pushed to the temporary-fitting position or to the final-fitting position from the temporary-fitting position, the engagement pawls 23, 24 are resiliently deformed as pushed by the external surfaces of the connector body 1. When the shield frame 2 is pushed from the temporary-fitting position to the final-fitting position, the engagement pawls 23 are deformed because the engagement pawls 23 pass over the inclined surfaces 15. However, the hanging pieces 22 are fitted in and guided by the positioning projections 42. This minimizes the possibility of the shield frame 2 coming up from the connector body 1 due to deformation of the engagement pawls 23.

In a production line, the electrical connector C having the arrangement mentioned above is manufactured with the shield frame 2 temporarily fixed to the connector body 1 at the temporary-fitting position. The electrical connector C in such a state is then supplied to a distribution stage or a stage of mounting the electrical connector C on the circuit board P. It is therefore possible to prevent the shield frame 2 and the contact pieces 21 from being deformed. When mounting the electrical connector C on the circuit board P, the external terminals 34 may be soldered to the circuit board P with the shield frame 2 remaining temporarily fixed to the connector body 1. Thereafter, the shield frame 2 may be pushed to the final-fitting position so that, as shown in FIG. 4, the contact pieces 21 are bent as they are pushed to the circuit board P, thus producing required contact pressures.

The electrical connector C shown in FIGS. 1 to 5 is arranged such that each engagement pawl 24 and each engagement pawl 23 respectively correspond to each temporary-fitting engagement portion 44 and each inclined surface 15 which are operated at the time of temporary fitting of the shield frame 2, and such that each engagement pawl 23 corresponds to each final-fitting engagement portion 16 which is operated at the time of final-fitting of the shield frame 2. However, an electrical connector C1 shown in FIG. 6 is arranged such that the same engagement pawl 126 on a shield frame 102 corresponds to a temporary-fitting engagement portion 144, an inclined surface 115 and a final-fitting engagement portion 116. In the electrical connector C1 in FIG. 6, the temporary-fitting engagement portion 144, the inclined surface 115 and the final-fitting engagement portion 116 are formed on the same lateral side of a connector body 101. The inclined surface 115 extends from the temporary-fitting engagement portion 144. The electrical connector C1 in FIG. 6 is arranged such that, while the shield frame 102 is pushed to the connector body 101, the same engagement pawl 126 is successively engaged with the temporary-fitting engagement portion 144, the inclined surface 115 and the final-fitting engagement portion 116.

In the electrical connector C1 in FIG. 6, when the shield frame 102 is temporarily fitted, the inclined surface 115 moves opposite to the back side of the engagement pawl 126 to maintain the shield frame 102 as temporarily fitted.

FIG. 7 shows an electrical connector C2 in accordance with a further embodiment of the present invention. In this connector C2, a connector body 201 is provided on a lateral side thereof with a temporary-fitting engagement portion 244 and a final-fitting engagement portion 216, the portion 216 being formed at a position lower than that of the portion 244. No inclined surface is formed on a lateral side of the connector body 201. More specifically, the connector body 201 is provided on its lateral side above-mentioned with a slot 201*a*, an upper-end stepped portion of which forms the temporary-fitting engagement portion 244, and the lower-end stepped portion of which stands from the bottom of the slot 201*a* at a right angle thereto. The final-fitting engagement portion 216 is formed under the slot 201*a*. Under an engagement pawl 226, the shield frame 202 has a semi-spherical projection 202*a* adapted to be engaged with the lower-end stepped portion of the slot 201*a* when the engagement pawl 226 is engaged with the temporary-fitting engagement portion 244. More specifically, the lower-end stepped portion of the slot 201*a* forms a temporary-fitting stepped portion 244*b*. When the shield frame 202 is pushed from the temporary-fitting position to the final-fitting position, first the slot 202*a* and then the engagement pawl 226 successively get over the temporary-fitting stepped portion 244*b*, so that the engagement pawl 226 is engaged with the final-fitting engagement portions 216.

In an electrical connector in accordance with still another embodiment of the present invention, the semi-spherical projection 202*a* in the electrical connector C2 in FIG. 7 may be formed on another lateral side of the shield frame 202 having no engagement pawl 226.

It is apparent that the semi-spherical projection 202*a* in FIG. 7 may be adopted in the electrical connector C shown in FIGS. 1 to 5. In the electrical connector C in FIGS. 1 to 5, the back sides of the engagement pawls 23 move opposite to the inclined surfaces 15 at the temporary-fitting position. In this embodiment, however, provision may be merely made such that, at the final-fitting position, the engagement pawl is engaged with the final-fitting engagement portion and, at the temporary-fitting position, the inwardly projecting semi-spherical projection of the shield frame is engaged with the lower-end stepped portion of the slot formed at the connector body.

All the semi-spherical projections mentioned above are disposed for preventing, at the time of temporary fitting, the shield frame from being pushed to the final-fitting position with a small force. Accordingly, all the semi-spherical projections mentioned above may be replaced with engagement pawls. In this case, it is a matter of course that the connector body has inclined surfaces adapted to be opposite to the back sides of the engagement pawls at the temporary-fitting position.

What is claimed is:

1. In an electrical connector having a connector body with a lower end and a shield frame fittingly mounted on said connector body, said shield frame having lateral sides and a lower end, said shield frame being provided at the lower end thereof with contact pieces adapted to be pressed to a member on which said electrical connector is to be mounted, said electrical connector comprising:

a plurality of upwardly inclined engagement pawls which project inwardly from a lateral side of said shield frame, each said pawl having a tip and a back side, said pawls being divided into two groups of at least one engagement pawl adapted to be engaged with the temporary-fitting engagement portion at the temporary-fitting position, and at least one engagement pawl adapted to be engaged with the final-fitting engagement portion at the final-fitting position, and only said engagement pawl engaged with said final-fitting engagement portion being opposite to the inclined surface at the temporary-fitting position;

at least one temporary-fitting engagement portion adapted to be engaged with the tip of said engagement pawl when said shield frame is pushed to a temporary-fitting position where said contact pieces do not project from the lower end of said connector body, said temporary-fitting engagement portion being formed on said connector body;

at least one final-fitting engagement portion adapted to be engaged with the tip of said engagement pawl when said shield frame is pushed to a final-fitting position where said contact pieces project from the lower end of said connector body, said final-fitting engagement portion being formed on said connector body; and at least one inclined surface adapted to be opposite to the back side of said engagement pawl at said temporary-fitting position, said inclined surface being formed on said connector body.

2. An electrical connector according to claim 1, wherein the engagement pawl engaged with the final-fitting engagement portion and the engagement pawl engaged with the temporary-fitting engagement portion are respectively formed on different lateral sides of the shield frame.

3. An electrical connector according to claim 1, wherein the tip of the same engagement pawl is successively engaged with the temporary-fitting engagement portion and the final-fitting engagement portion.

4. An electrical connector according to claim 1, wherein the shield frame is provided at the lower end thereof with hanging pieces fitted in holes formed in the connector body.

5. In an electrical connector having a connector body with an upper-end periphery and a lower end and a shield frame fittingly mounted on said connector body, said shield frame having lateral sides, a lower end and an upper peripheral end, said shield frame being provided at the lower end thereof with contact pieces adapted to be pressed to a member on which said electrical connector is to be mounted, said electrical connector comprising:

an upwardly inclined engagement pawl which projects inwardly from a lateral side of said shield frame, said engagement pawl having a tip;

a projection projecting inwardly from a lateral side of said shield frame;

a temporary-fitting engagement portion with which the tip of said engagement pawl is adapted to be engaged when said shield frame is pushed to a temporary-fitting position where said contact pieces do not project from the lower end of said connector body, said temporary-fitting engagement portion being formed on said connector body;

a temporary-fitting stepped portion with which said projection is adapted to be engaged when said shield frame is pushed to said temporary-fitting position, said stepped portion being formed on said connector body; and a final-fitting engagement portion with which the tip of said engagement pawl is adapted to be engaged when said shield frame is pushed to a final-fitting position where said contact pieces project from the lower end of said connector body, said final-fitting engagement portion being formed on said connector body, wherein the shield frame is provided at the upper peripheral end thereof with a peripheral edge adapted to come in contact with the upper-end periphery of the connector body at the final-fitting position.

6. An electrical connector according to claim 5, wherein the engagement pawl and the projection are formed on the same lateral side of the shield frame.

7. An electrical connector according to clam 5, wherein the engagement pawl and the projection are respectively formed on different lateral sides of the shield frame.

8. An electrical connector according to claim 5, wherein the projection is a cut-raised engagement pawl, and the temporary-fitting stepped portion is an inclined surface.

9. An electrical connector according to claim 5, wherein the shield frame is provided at the lower end thereof with hanging pieces adapted to be fitted in holes formed in the connector body.

10. An electrical connector according to claim 5, wherein the projection is semi-spherical.

11. An electrical connector according to claim 6, wherein the projection is semi-spherical.

12. An electrical connector according to claim 7, wherein the projection is semi-spherical.

13. In an electrical connector having a connector body and a shield frame fittingly mounted on said connector body, said shield frame having lateral sides, a lower end and an upper peripheral end, said shield frame being provided at the lower end thereof with contact pieces adapted to be pressed to a member on which said electrical connector is to be mounted, said electrical connector comprising:

an upwardly inclined temporary-fitting engagement pawl which projects inwardly from a lateral side of said shield frame, said temporary-fitting engagement pawl having a tip;

an upwardly inclined final-fitting engagement pawl which projects inwardly from a lateral side of said shield frame, said final-fitting engagement pawl having a tip;

a projection projecting inwardly from a lateral side of said shield frame;

a temporary-fitting engagement portion with which the tip of said temporary-fitting engagement pawl is adapted to be engaged when said shield frame is pushed to a temporary-fitting position where said contact pieces do not project from the lower end of said connector body, said temporary-fitting engagement portion being formed on said connector body;

a temporary-fitting stepped portion with which said projection is adapted to be engaged when said shield frame is pushed to said temporary-fitting position, said stepped portion being formed on said connector body; and a final-fitting engagement portion with which the tip of said final-fitting engagement pawl is adapted to be engaged when said shield frame is pushed to a final-fitting position where said contact pieces project from the lower end of said connector body, said final-fitting engagement portion being formed on said connector body.

14. An electrical connector according to claim 13, wherein the final-fitting engagement pawl and the projection are formed on the same lateral side of the shield frame, and the temporary-fitting engagement pawl is formed on other lateral side of said shield frame.

15. An electrical connector according to claim 13, wherein the projection is semi-spherical.

16. An electrical connector according to claim 13, wherein the shield frame is provided at the lower end thereof with hanging pieces adapted to be fitted in holes formed in the connector body.

17. An electrical connector according to claim 13, wherein the shield frame is provided at the upper peripheral end thereof with a peripheral edge adapted to come in contact with the upper-end periphery of the connector body at the final-fitting position.

18. In an electrical connector having a connector body with an upper-end periphery and a lower end and a shield frame fittingly mounted on said connector body, said shield frame having lateral sides, a lower end and an upper peripheral end, said shield frame being provided at the lower end thereof with contact pieces adapted to be pressed to a member on which said electrical connector is to be mounted, said electrical connector comprising:

at least one upwardly inclined engagement pawl which projects inwardly from a lateral side of said shield frame, each said pawl having a tip and a back side;

at least one temporary-fitting engagement portion adapted to be engaged with the tip of said engagement pawl when said shield frame is pushed to a temporary-fitting position where said contact pieces do not project from the lower end of said connector body, said temporary-fitting engagement portion being formed on said connector body;

at least one final-fitting engagement portion adapted to be engaged with the tip of said engagement pawl when said shield frame is pushed to a final-fitting position where said contact pieces project from the lower end of said connector body, said final-fitting engagement portion being formed on said connector body; and at least one inclined surface adapted to be opposite to the back side of said engagement pawl at said temporary-fitting position, said inclined surface being formed on said connector body, wherein the shield frame is provided at the upper peripheral end thereof with a peripheral edge adapted to come in contact with the upper-end periphery of the connector body at the final-fitting position.

* * * * *

UNITED STATES PATENT AND TRADEMARK OFFICE

CERTIFICATE OF CORRECTION

PATENT NO. : 5,030,140

DATED : July 9, 1991

INVENTOR(S) : Keishi Sugiyama

It is certified that error appears in the above-identified patent and that said Letters Patent is hereby corrected as shown below:

Claim 7, column 10, line 23, "clam" should be "claim".

Signed and Sealed this

Twentieth Day of October, 1992

*Attest:*

DOUGLAS B. COMER

*Attesting Officer*

*Acting Commissioner of Patents and Trademarks*